United States Patent [19]

Hanchett, Jr. et al.

[11] Patent Number: 4,669,766

[45] Date of Patent: Jun. 2, 1987

[54] DOOR HOLDING MAGNET

[75] Inventors: Leland J. Hanchett, Jr., Phoenix; Mark A. Lawrence, Mesa, both of Ariz.

[73] Assignee: Hanchett Entry Systems, Inc., Phoenix, Ariz.

[21] Appl. No.: 906,647

[22] Filed: Sep. 11, 1986

Related U.S. Application Data

[63] Continuation of Ser. No. 578,882, Feb. 10, 1984, abandoned.

[51] Int. Cl.[4] ..... E05C 17/56

[52] U.S. Cl. ..... 292/251.5; 403/90

[58] Field of Search ..... 292/251.5; 411/537, 411/538, 395, 389; 403/76, 90, 122, 131

[56] References Cited

U.S. PATENT DOCUMENTS

| | | | |
|---|---|---|---|
| 1,883,796 | 10/1932 | King | 403/90 X |
| 2,611,066 | 9/1952 | Freeman | 411/395 X |
| 2,871,676 | 2/1959 | Miller et al. | 292/251.5 |
| 3,204,154 | 8/1965 | Crandell | 292/251.5 |
| 3,204,898 | 9/1965 | Manning | 403/90 X |
| 3,781,047 | 12/1973 | Surko | 292/251.5 |

FOREIGN PATENT DOCUMENTS

| | | | |
|---|---|---|---|
| 136514 | 12/1919 | United Kingdom | 411/389 |

*Primary Examiner*—Robert L. Wolfe
*Assistant Examiner*—Lloyd A. Gall
*Attorney, Agent, or Firm*—Richards, Harris, Medlock & Andrews

[57] ABSTRACT

A door holding mechanism (10) is provided for holding a door (14) in an open position adjacent a wall (12). The door holding mechanism (10) includes a cylindrical housing (18). A magnetic coil (30) is mounted within the cylindrical housing (18). Structure (40, 50, 60, 64) is provided for pivotally mounting the cylindrical housing (18) to the wall (12). A door plate (68) is mounted on the door (14) which is magnetically attracted to the cylindrical housing (18) to hold the door (14) in an open position.

8 Claims, 3 Drawing Figures

DOOR HOLDING MAGNET

This application is a continuation of application Ser. No. 578,882, filed 02/10/84.

TECHNICAL FIELD

This invention relates to security devices, and more particularly to a device for maintaining a door in an open position and for automatically releasing the door.

BACKGROUND ART

In many situations it is desirable to hold a door an open position. Devices for this purpose may be utilized with automatic closing devices which are used for remotely closing a door when a condition, such as smoke or heat, for example, is present and it is desired that a particular entryway be secured.

Previously developed door holding devices have utilized fixed and flush mounted magnets on the wall adjacent the door and a plate on the door to achieve alignment between the magnet and door plate. A major obstacle in holding the door open when using such a fixed magnet device lies in the problem of aligning the magnet gap of the wall mounted magnet with the gap bridging plate located on the door. These previously developed devices have employed a pivoting device on the door to provide such alignment. By placing a movable device on the movable door, an imprecise arrangement results in that the door plate must be adjusted each time the plate comes into contact with the magnet mounted on the wall.

A need has thus arisen for a door holding magnet to be attached to a wall which is initially aligned and locked into position to eliminate readjustment each time the door engages the magnet.

DISCLOSURE OF THE INVENTION

In accordance with the present invention, a door holding magnet is provided for substantially eliminating the alignment problems heretofore associated with door holding magnets.

In accordance with the present invention, a door holding mechanism for holding a door in an open position adjacent a wall is provided. The door holding mechanism includes a housing and an electromagnet mounted within the housing. Structure is provided for pivotally mounting the housing to the wall. A plate is mounted on the door adjacent the housing and the housing is alignable with the door plate to enable the electromagnet, when energized, to magnetically attract the door plate and thereby hold the door in the open position.

In accordance with another aspect of the present invention, a door holding mechanism for holding a door in an open position adjacent a wall is provided. The mechanism includes a housing including first and second ends. The first end of the housing includes an aperture and the second end includes a concave surface. An electromagnet is mounted within the housing aperture. A bearing member having a convex surface is provided for bearing against the concave surface of the housing. A wall plate is mounted to the wall and a door plate is mounted to the door adjacent the housing. Structure is provided for connecting the housing and the bearing member to the wall plate.

In accordance with yet another aspect of the present invention, a door holding mechanism for holding a door in an open position adjacent a wall is provided. The mechanism includes a housing having first and second ends. The housing first end includes an aperture and the second end includes a concave surface. An electromagnetic coil is disposed within the housing aperture. An electromagnetic armature is disposed within the electromagnetic coil for closing the housing aperture. A bearing member having a convex surface is provided for bearing against the concave surface of the housing. A wall plate is mounted to the wall. A shaft having first and second ends is provided which extends through the bearing member and the housing such that the first end thereof is connected to the electromagnetic armature. The second end of the shaft is connected to the wall plate. A door plate is mounted to the door adjacent the housing. Structure is provided for locking the housing to the bearing member in a desired position for aligning the housing and the door plate.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION

Figure 1:
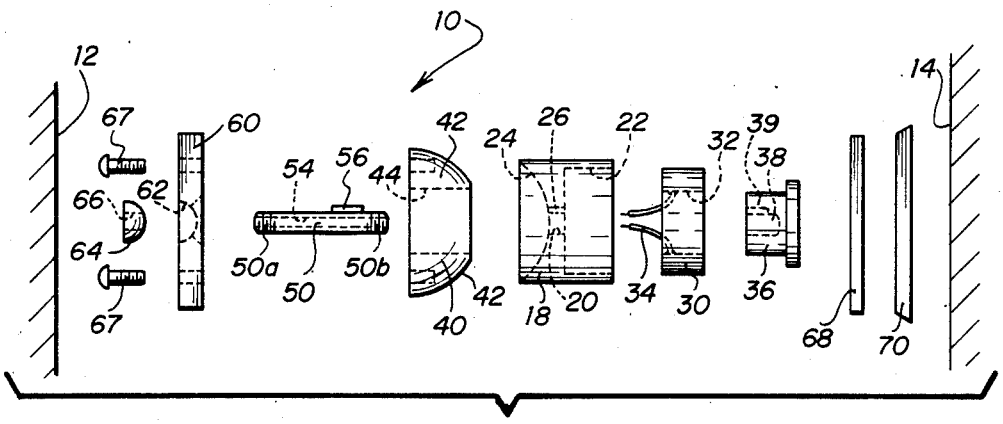
FIG. 1 is an exploded view illustrating the door holding mechanism of the present invention.
Figure 2:
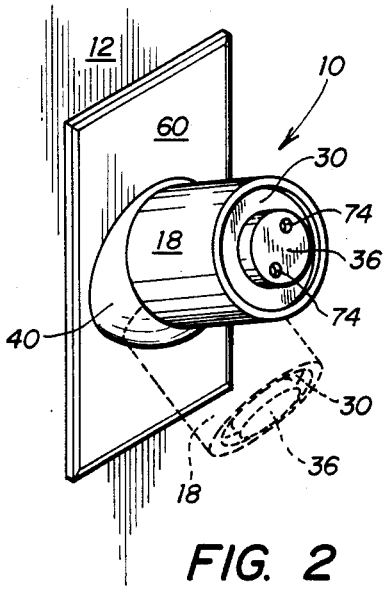
FIG. 2 is a perspective view of the present door holding mechanism illustrating the range of motion of the present housing.
Figure 3:
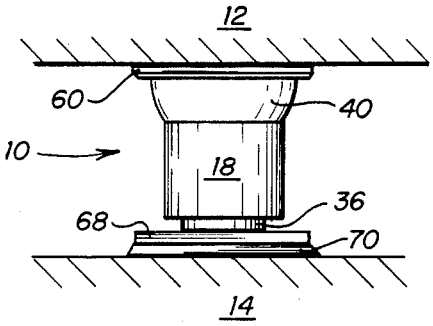
FIG. 3 is a top plan view of the present door holding mechanism disposed between a wall and a door.

Referring simultaneously to FIGS. 1, 2 and 3, the present door holding mechanism is illustrated and is generally identified by the numeral 10. Door holding mechanism 10 is mounted to a wall 12 which lies adjacent a door 14. Through operation of door holding mechanism 10, door 14 is held in an open position adjacent wall 12.

Door holding mechanism 10 includes a cylindrical housing 18 having a central bore 20 therethrough. Cylindrical housing 18 includes an aperture 22 at one end thereof and a concave bearing surface 24 at the other end thereof. Central bore 20 interconnects concave bearing surface 24 and aperture 22. Also disposed within cylindrical housing 18 and communicating with central bore 20 is a keyway 26.

Disposed within aperture 22 of cylindrical housing 18 is a magnetic coil 30 which includes a central bore 32. Magnetic coil 30 is energized from a power source (not shown) through wires 34. Disposed within central bore 32 of magnetic coil 30 is an armature 36 which includes a threaded bore 38. Armature 36 is positioned within central bore 32 of magnetic coil 30, which in turn is positioned within aperture 22 of circular housing 18. Wires 34 lie within central bore 20.

Mounted adjacent to concave bearing surface 24 of cylindrical housing 18 is a bearing member 40 having a convex surface 42 and a central bore 44.

Door holding mechanism 10 further includes a threaded shaft 50 having threaded ends **50*a* and 50*b*. Threaded shaft 50 also includes a central bore 54 and a key 56. Threaded shaft 50 is disposed within central bore 20 of cylindrical housing 18 such that threaded end 50*b* of threaded shaft 50 engages threaded bore 38 of armature 36. Threaded end 50*a* of threaded shaft 50** extends from central bore 44 of bearing member 40. Key 56 engages keyway 26 of cylindrical housing 18 to prevent relative motion between threaded shaft 50 and cylindrical housing 18. Wires 34 of magnetic coil 30 enter the armature through a slot 39 and enter shaft 50 at end 50*b* and pass through threaded shaft 50 and bearing member 40 to exit threaded shaft 50 at threaded end 50*a*.

Mounted to wall 12 is a mounting plate 60 having a concave aperture 62 which receives a nut 64. Nut 64 includes a threaded bore 66 for receiving threaded end 50*a* of threaded shaft 50. Bearing member 40 is attached to mounting plate 60 using screws 67.

Mounted to door 14 is a door plate 68 which lies adjacent to door holding mechanism 10. Disposed between door plate 68 and door 14 is a shock absorbing cushion 70 which may comprise, for example, rubber material. When energized, the electromagnet composed of armature 36 and magnetic coil 30 produces a magnetic field to attract door plate 68 to hold door 14 adjacent wall 12. A concentric flux gap exists between the outside diameter of armature 36 and the inside diameter of aperture 22. This flux gap is bridged by door plate 68, such that door plate 68 is magnetically attracted to armature 36.

Referring now to FIG. 2, it can be seen that cylindrical housing 18 is arcuately slidable over convex surface 42 of bearing member 40 between the position illustrated in solid lines and the position illustrated in dotted lines. The range of movement of cylindrical housing 18 is approximately 30° with respect to the plane of wall 12. The positioning of cylindrical housing 18 adjusts the plane of the flux gap within cylindrical housing 18 with respect to the plane of wall 12 to thereby provide correct alignment with the plane of door 14. A spanner wrench may be utilized to loosen armature 36 on threaded shaft 50 by engaging recesses 74 on the surface of armature 36. Once the correct position of circular housing 18 is established, the spanner wrench can be utilized to tighten armature 36 thus clamping cylindrical housing 18 to bearing member 40 as threaded end 50*a* of threaded shaft 50 engages nut 64.

Keyway 26 of cylindrical housing 18 engages key 56 of threaded shaft 50 to prevent turning of threaded shaft 50 when cylindrical housing 18 is held as armature 36 is tightened by use of the spanner wrench. Nut 64 is held onto threaded shaft 50 using a sealant such as LOCTITE, a trademark of the Loctite Corporation, to prevent nut 64 from disengaging threaded shaft 50.

FIG. 3 illustrates the placement of door holding mechanism 10 on wall 12 adjacent to door 14. Door plate 68 is mounted to the rear of door 14, for example, at the top adjacent cylindrical housing 18 which in turn is mounted to wall 12.

Therefore, it can be seen that the present door holding mechanism provides for a pivotable housing mounted to a wall for aligning an electromagnet with a plate mounted on a door. Upon de-energization of the electromagnet, the door is automatically closed. De-energization of the electromagnet can be controlled by heat or smoke detectors to thereby automatically secure an area which is accessible through the door.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A door holding mechanism for holding a door in an open position adjacent a wall comprising:

a housing having first and second ends, said first end including an aperture and said second end having a concave surface;

an electromagnet mounted within said housing aperture, comprising a coil and an armature disposed within said coil;

a bearing member having a convex surface for bearing against said concave surface of said housing;

a wall plate mounted to the wall;

a door plate mounted to the door adjacent said housing;

means disposed between said door plate and the door for absorbing shock between said housing and the door; and mounting means for arcuately connecting said housing and said bearing member to said wall plate including a shaft extending through said housing and said bearing member and connecting said armature and said wall plate.

2. A door holding mechanism for holding a door in an open position adjacent a wall comprising:

a housing;

an electromagnet mounted within said housing, comprising a coil and an armature disposed within said coil;

a door plate mounted on the door adjacent said housing;

means for pivotally mounting said housing to the wall including:

a wall plate mounted to the wall;

a shaft disposed within said housing for interconnecting said armature and said wall plate; and means disposed between said wall plate and said housing for arcuately positioning said housing with respect to said wall plate;

said mounting means allowing said housing to be aligned with said door plate to enable said electromagnet, when energized, to magnetically attract said door plate to thereby hold the door in the open position.

3. The door holding mechanism of claim 1 wherein said shaft includes a key for engaging said housing.

4. The door holding mechanism of claim 1 and further including:

means disposed between said door plate and the door for absorbing shock between said housing and the door.

5. The door holding mechanism of claim 1 wherein said means for pivotally mounting said housing to the wall includes:

means for clamping said housing in a desired position with respect to said mounting means.

6. A door holding mechanism for holding a door in an open position adjacent a wall comprising:

a housing having first and second ends, said first end including an aperture and said second end having a concave surface;

a coil disposed within said housing aperture;

an electromagnetic armature disposed within said coil;

a bearing member having a convex surface for bearing against said concave surface of said housing;

a wall plate mounted to the wall;

a shaft having first and second ends and extending through said bearing member and said housing, such that said first end thereof is connected to said electromagnetic armature;

said second end of said shaft being connected to said wall plate;

a door plate mounted to the door adjacent to said housing; and means for clamping said housing to said bearing member in a desired position for aligning said housing mounted to the wall with said door plate mounted to the door.

7. The door holding mechanism of claim 6 and further including:

means disposed between said door plate and the door for absorbing shock between said housing and the door.

8. The door holding mechanism of claim 6 wherein said shaft includes:

a key for engaging said housing to prevent rotation of said shaft with respect to said housing.

* * * * *